US010228629B2

(12) United States Patent
Tamura et al.

(10) Patent No.: US 10,228,629 B2
(45) Date of Patent: Mar. 12, 2019

(54) TONER

(71) Applicant: CANON KABUSHIKI KAISHA, Tokyo (JP)

(72) Inventors: Junichi Tamura, Toride (JP); Hayato Ida, Toride (JP); Takaho Shibata, Tokyo (JP); Yuya Chimoto, Funabashi (JP); Kouichirou Ochi, Chiba (JP); Ryuji Murayama, Nagareyama (JP); Daisuke Yamashita, Tokyo (JP); Tomoyo Miyakai, Kashiwa (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/873,020

(22) Filed: Jan. 17, 2018

(65) Prior Publication Data

US 2018/0203370 A1 Jul. 19, 2018

(30) Foreign Application Priority Data

Jan. 19, 2017 (JP) ..... 2017-007435

(51) Int. Cl.
*G03G 9/087* (2006.01)

(52) U.S. Cl.
CPC ..... *G03G 9/08797* (2013.01); *G03G 9/08755* (2013.01); *G03G 9/08759* (2013.01); *G03G 9/08788* (2013.01); *G03G 9/08795* (2013.01)

(58) Field of Classification Search
CPC ..... G03G 9/08759; G03G 9/08762; G03G 9/08788; G03G 9/08797; G03G 9/08791; G03G 9/08784; G03G 9/08795; G03G 9/08755
USPC ..... 430/109.4
See application file for complete search history.

(56) References Cited

U.S. PATENT DOCUMENTS

| | | | |
|---|---|---|---|
| 3,853,778 A | 12/1974 | Buckley et al. | |
| 5,916,996 A | 6/1999 | Sacripante et al. | |
| 7,833,687 B2 | 11/2010 | Kato et al. | |
| 8,697,327 B2 | 4/2014 | Shibata et al. | |
| 9,057,970 B2 | 6/2015 | Ida et al. | |
| 9,348,247 B2 | 5/2016 | Ida et al. | |
| 9,540,483 B2 | 1/2017 | Ida et al. | |
| 9,696,644 B2 | 7/2017 | Ida et al. | |
| 9,897,934 B2 | 2/2018 | Tamura et al. | |
| 2006/0105258 A1 | 5/2006 | Ishiyama et al. | |
| 2013/0108955 A1 | 5/2013 | Shibata et al. | |
| 2013/0202998 A1 | 8/2013 | Higashi et al. | |
| 2015/0099227 A1 | 4/2015 | Ida et al. | |
| 2016/0091813 A1* | 3/2016 | Yoshiba | G03G 9/08797 430/109.4 |
| 2017/0329245 A1 | 11/2017 | Shibata et al. | |

FOREIGN PATENT DOCUMENTS

| | | |
|---|---|---|
| JP | S56-013943 B2 | 4/1981 |
| JP | S62-039428 B2 | 8/1987 |
| JP | H04-120554 A | 4/1992 |
| JP | 2016-110140 | 6/2016 |

OTHER PUBLICATIONS

Yuji Harazaki, "Basic Coating Science" Sep. 15, 1977, First Edition Issued, Table 3-9, pp. 55-56. (Discussed in specification paragraph No. [0031].).
U.S. Appl. No. 15/687,726, Daisuke Yamashita, filed Aug. 28, 2017.
U.S. Appl. No. 15/693,662, Hayato Ida, filed Sep. 1, 2017.
U.S. Appl. No. 15/730,337, Tomoyo Miyakai, filed Oct. 11, 2017.
U.S. Appl. No. 15/807,766, Yuto Onozaki, filed Nov. 9, 2017.
U.S. Appl. No. 15/813,713, Yuto Onozaki, filed Nov. 15, 2017.

* cited by examiner

*Primary Examiner* — Janis L Dote
(74) *Attorney, Agent, or Firm* — Venable LLP

(57) ABSTRACT

A toner comprising a toner particle that contains a hybrid resin A and a crystalline polyester resin B, wherein the hybrid resin A has a polyester segment, and a polypropylene glycol segment that has a number-average molecular weight of at least 300, the polyester segment has a structure derived from a condensation reaction between a dicarboxylic acid and a diol, and has an aromatic ring in at least one of the dicarboxylic acid and the diol, and the following condition is satisfied:

$$|SPh-SPc|-|SPp-SPc|<1$$

where, SPh is SP value of the polyester segment of the hybrid resin A, SPc is SP value of the crystalline polyester resin B, and SPp is SP value of the polypropylene glycol segment of the hybrid resin A.

9 Claims, No Drawings

TONER

BACKGROUND OF THE INVENTION

Field of the Invention

The present invention relates to a toner for developing an electrostatic image used in, for example, electrophotography and electrostatic recording methods.

Description of the Related Art

In recent years, the upsurge in the demand for energy savings during image formation has been accompanied by initiatives to bring about additional reductions in the toner fixation temperature. The use of a polyester having a low softening temperature to bring about a further lowering of the fixation temperature has been proposed as one such initiative. However, due to the low softening temperature, toners end up melt-adhering to each other under static conditions, e.g., during storage or during transport, and coagulation can thus be produced.

In Japanese Examined Patent Publication Nos. S56-13943 and S62-39428 and Japanese Patent Application Laid-open No. H04-120554, art is proposed in which a crystalline resin having a sharp melt property, i.e., its viscosity undergoes a large decline when the melting point is exceeded, is used as a means for having the coagulation resistance coexist with the low-temperature fixability.

SUMMARY OF THE INVENTION

A major problem that has occurred when a crystalline resin is used by itself for toner is that, after triboelectric charging, the charge on the toner gradually escapes due to the low electrical resistance of the crystalline resin.

On the other hand, crystalline resin/amorphous resin combinations have also been used as toner materials. In this case, high compatibility between the crystalline resin and amorphous resin is required in order to obtain low-temperature fixability. However, when a high compatibility between the two resins is present, a problem has occurred wherein the charging performance and storability (for example, the coagulation resistance) have been reduced due to a reduction in the glass transition temperature (also referred to below simply as "Tg") of the toner caused by compatibilization between the crystalline resin and amorphous resin during toner production.

Moreover, when a low-compatibility combination has been selected for the crystalline resin and amorphous resin in order to maintain the charging performance and coagulation resistance, a charging performance and coagulation resistance have been obtained, but the problem has been that the appearance of the plasticizing effect by the crystalline resin for the amorphous resin has been suppressed and the appearance of low-temperature fixability has then been impaired.

An object of the present invention is to provide a toner that exhibits all of the following at high levels: low-temperature fixability, storability, and charging performance.

As a result of focused investigations, the present inventors discovered that—through the use, as the amorphous resin to be used in combination with the crystalline polyester resin, of a hybrid resin having a polypropylene glycol segment and a polyester segment that has an aromatic ring in at least one of the dicarboxylic acid and the diol—a toner is obtained in which the low-temperature fixability, storability, and charging performance coexist with each other in good balance.

The discovery was also made that—by having the difference between the SP values of the polyester segment of the hybrid resin and the aforementioned crystalline polyester resin reside in a special relationship with the difference between the SP values of the polypropylene glycol segment of the hybrid resin and the aforementioned crystalline polyester resin—a toner is obtained in which the low-temperature fixability, storability, and charging performance are all exhibited at high levels while the low-temperature fixability is also not impaired even after a storage environment.

That is, the present invention relates to a toner comprising a toner particle that contains a hybrid resin A and a crystalline polyester resin B, wherein the hybrid resin A has a polyester segment, and a polypropylene glycol segment that has a number-average molecular weight of at least 300, the polyester segment has a structure derived from a condensation reaction between a dicarboxylic acid and a diol, and has an aromatic ring in at least one of the dicarboxylic acid and the diol, and the following condition is satisfied:

$$|SPh-SPc|-|SPp-SPc|<1$$

SPh: SP value of the polyester segment of the hybrid resin A

SPc: SP value of the crystalline polyester resin B

SPp: SP value of the polypropylene glycol segment of the hybrid resin A.

The following is thought with regard to the detailed mechanism. With the use of the indicated hybrid resin, a hard segment composed of the polyester segment and a soft segment composed of the polypropylene glycol segment form a pseudo-block structure. It is thought that since the hard segment has a high glass transition temperature (Tg), stiffness is exhibited at and above the glass transition temperature (Tg) of the hybrid resin and an excellent storability is then obtained.

In addition, an $|SPh-SPc|-|SPp-SPc|$ of less than 1 indicates that the compatibility of the hard segment with the crystalline polyester resin is near to or higher than the compatibility of the soft segment with the crystalline polyester resin. By having the SP value relationship be in the indicated range, at the time of fixing the crystalline polyester resin compatibilizes with the polyester segment, i.e., the hard segment, to the same extent as for the soft segment or to a greater extent than for the soft segment, causing softening, and as a consequence the viscosity of the toner as a whole can be efficiently lowered. As a result, even with the crystalline resin and amorphous resin being phase-separated, it becomes possible to cause the viscosity of the toner as a whole to undergo an instantaneous decline and an excellent low-temperature fixability can be obtained even at short fixing times with fixing units operating at fast paper feed rates.

Moreover, because the amorphous resin has a soft segment, the amount of crystalline polyester resin in the toner can be lowered and a high charging performance can then be obtained.

The present invention is thus able to provide a toner that exhibits all of the following at high levels: low-temperature fixability, storability, and charging performance.

Further features of the present invention will become apparent from the following description of exemplary embodiments.

DESCRIPTION OF THE EMBODIMENTS

Unless specifically indicated otherwise, expressions such as "at least XX and not more than YY" and "XX to YY" that show numerical value ranges refer in the present invention to numerical value ranges that include the lower limit and upper limit that are the end points.

The present invention relates to a toner comprising a toner particle that contains a hybrid resin A and a crystalline polyester resin B, wherein the hybrid resin A has a polyester segment, and a polypropylene glycol segment that has a number-average molecular weight of at least 300, the polyester segment has a structure derived from a condensation reaction between a dicarboxylic acid and a diol, and has an aromatic ring in at least one of the dicarboxylic acid and the diol, and the following condition is satisfied:

$$|SPh-SPc|-|SPp-SPc|<1$$

SPh: SP value of the polyester segment of the hybrid resin A

SPc: SP value of the crystalline polyester resin B

SPp: SP value of the polypropylene glycol segment of the hybrid resin A.

The constituent materials of the toner of the present invention are described in the following.

Hybrid Resin A

The toner particle contains a hybrid resin A. The hybrid resin A is obtained by the condensation polymerization of a dicarboxylic acid and diol and also a polypropylene glycol having a number-average molecular weight of at least 300. This condensation polymerization can be carried out by a known method.

The dicarboxylic acid used in the hybrid resin A is not particularly limited, but can be exemplified by the following:

aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acid substituted by an alkyl group or alkenyl group having at least 6 and not more than 18 carbons, and their anhydrides; unsaturated dicarboxylic acids such as fumaric acid, maleic acid, and citraconic acid, and their anhydrides; and dicarboxylic acid derivatives that are derivatives of the preceding. The dicarboxylic acid derivatives should be dicarboxylic acid derivatives that provide the same resin structure by the aforementioned condensation polymerization, but are not otherwise particularly limited. Examples here are compounds provided by the methyl esterification or ethyl esterification of the preceding dicarboxylic acids and compounds provided by conversion of the preceding dicarboxylic acids into the acid chloride.

The dicarboxylic acid preferably has an aromatic ring. The dicarboxylic acid for forming the hard segment more preferably contains terephthalic acid or a terephthalic acid derivative (e.g., dimethyl terephthalate, diethyl terephthalate). That is, the dicarboxylic acid preferably contains a terephthalic acid.

The diol used in the hybrid resin A is not particularly limited and can be exemplified by the following:

alkylene oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, and also ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, bisphenol A, hydrogenated bisphenol A, and derivatives of the preceding. These derivatives should provide the same resin structure by the aforementioned condensation polymerization, but are not otherwise particularly limited. Examples here are derivatives provided by the esterification (e.g., methyl ester, ethyl ester) of the aforementioned alcohol components.

The diol preferably has an aromatic ring. The diol for forming the hard segment more preferably contains a propylene oxide adduct of bisphenol A. In addition, the diol is preferably a compound other than a polypropylene glycol. The propylene oxide adduct of bisphenol A is preferably a compound represented by the formula (2) below.

At least one of the dicarboxylic acid and diol has an aromatic ring. The proportion of the aromatic ring-containing dicarboxylic acid or diol, in the dicarboxylic acid or diol, respectively, is preferably at least 90 mol % and not more than 100 mol % and more preferably at least 95 mol % and not more than 100 mol %. Due to the presence of the aromatic ring, a rigid hard segment is formed and an excellent storability is then obtained.

The polypropylene glycol segment present in the hybrid resin A has a number-average molecular weight of at least 300 and preferably of at least 300 and not more than 3,000 and more preferably of at least 300 and not more than 1,000. That is, the polypropylene glycol segment is a segment derived from a polypropylene glycol that has a number-average molecular weight of at least 300. When the number-average molecular weight of the polypropylene glycol segment is at least 300, the low-temperature fixability is improved because a pseudo-block structure is obtained. The storability is excellent when the number-average molecular weight is not more than 3,000, and the storability is even better when the number-average molecular weight is not more than 1,000.

The method for measuring the number-average molecular weight is as follows.

The number-average molecular weight of the resin is measured as follows using gel permeation chromatography (GPC).

First, the sample (resin) is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a solvent-soluble component concentration of approximately 0.8 mass %. The measurement is performed under the following conditions using this sample solution.

instrument: HLC8120 GPC (detector: RI) (Tosoh Corporation)

columns: 7-column train of Shodex KF-801, 802, 803, 804, 805, 806, and 807 (Showa Denko K. K.)

eluent: tetrahydrofuran (THF)

flow rate: 1.0 mL/min oven temperature: 40.0° C.

sample injection amount: 0.10 mL

A calibration curve constructed using polystyrene resin standards is used to calculate the molecular weight of the sample.

The glass transition temperature Tg of the hybrid resin A is preferably at least 20° C. and not more than 40° C. and is more preferably at least 20° C. and not more than 30° C.

The storability is improved when Tg is at least 20° C.

In addition, in high-temperature, high-humidity environments, the charging performance is also improved due to a suppression of the reduction in resistance caused by the molecular motion of the resin. Moreover, the low-temperature fixability is improved when the glass transition temperature is not more than 40° C., and the low-temperature fixability is still further improved when the glass transition temperature is not more than 30° C.

This glass transition temperature (Tg) can be measured using a differential scanning calorimeter (DSC822/EK90, Mettler Toledo).

Specifically, at least 0.01 g and not more than 0.02 g of the sample is exactly weighed into an aluminum pan and heating is performed from 0° C. to 200° C. at a ramp rate of 10° C./min. Cooling is then carried out from 200° C. to −100° C. at a ramp down rate of 10° C./min, and the DSC curve is subsequently obtained during reheating from −100° C. to 200° C. at a ramp rate of 10° C./min.

The glass transition temperature is taken to be the temperature in the resulting DSC curve at the intersection of the straight line provided by extending the low-temperature side baseline to the high-temperature side, with the tangent line drawn at the point of the maximum slope in the curve segment for the stepwise change at the glass transition.

The content of the hybrid resin A in the toner particle is preferably at least 10 mass % and not more than 50 mass % and more preferably at least 15 mass % and not more than 30 mass %. When this range is adopted, the low-temperature fixability, storage stability, and charging performance reside at high levels and are excellent.

The content of a monomer unit derived from the polypropylene glycol in the total monomer unit forming the hybrid resin A is preferably at least 2.5 mol % and not more than 20 mol %, and more preferably at least 5 mol % and not more than 15 mol %. The low-temperature fixability, storability, and charging performance can be made to coexist with each other at high levels by incorporating the polypropylene glycol in the hybrid resin A in the indicated range. Here, monomer unit refers to the reacted state of the monomer material in the polymer or resin.

Crystalline Polyester Resin B

The crystalline polyester resin B should exhibit crystallinity, but is not otherwise particularly limited and can be selected as appropriate in accordance with the objective.

This crystalline polyester resin B has a melting endothermic peak (melting point) in differential scanning calorimetric measurement using a differential scanning calorimeter (DSC).

The crystalline polyester resin B is not particularly limited, and can be exemplified by crystalline polyester resins obtained by the condensation polymerization of an alcohol component and a carboxylic acid component.

The alcohol component can be specifically exemplified by the following:

ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexanediol, cyclohexanedimethanol, and derivatives of the preceding. The derivative should provide the same resin structure by the aforementioned condensation polymerization, but is not otherwise particularly limited. An example here is a compound in which the diol is esterified.

Among the preceding, linear aliphatic diols having at least 4 and not more than 10 carbons are preferred from the standpoint of the melting point and the SP value, infra.

Trihydric and higher hydric alcohols may also be used, e.g., glycerol, pentaerythritol, hexamethylolmelamine, and hexaethylolmelamine.

The carboxylic acid component can be specifically exemplified by the following:

oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; alicyclic dicarboxylic acids such as 1,1-cyclopentenedicarboxylic acid, 1,4-cyclohexanedicarboxylic acid, 1,3-cyclohexanedicarboxylic acid, and 1,3-adamantanedicarboxylic acid; aromatic dicarboxylic acids such as phthalic acid, isophthalic acid, terephthalic acid, p-phenylenediacetic acid, m-phenylenediacetic acid, p-phenylenedipropionic acid, m-phenylenedipropionic acid, naphthalene-1,4-dicarboxylic acid, and naphthalene-1,5-dicarboxylic acid; and derivatives of the preceding. The derivative should provide the same resin structure by the aforementioned condensation polymerization, but is not otherwise particularly limited. Examples here are compounds provided by the methyl esterification or ethyl esterification of the carboxylic acid and compounds provided by conversion of the carboxylic acid into the acid chloride.

Among the preceding, linear aliphatic dicarboxylic acids having at least 6 and not more than 12 carbons are preferred from the standpoint of the SP value, infra, and the melting point.

In addition, a tribasic or higher basic polybasic carboxylic acid may also be used, such as trimellitic acid, pyromellitic acid, naphthalenetricarboxylic acid, naphthalenetetracarboxylic acid, pyrenetricarboxylic acid, and pyrenetetracarboxylic acid.

A preferred example of the crystalline polyester resin B is a condensation polymer between a diol component containing a compound selected from the group consisting of linear aliphatic diols having at least 4 and not more than 10 carbons and derivatives thereof, and a dicarboxylic acid component containing a compound selected from the group consisting of linear aliphatic dicarboxylic acids having at least 6 and not more than 12 carbons and derivatives thereof.

That is, the crystalline polyester resin B preferably has a structure derived from a condensation reaction between a diol represented by the following formula (I) and a dicarboxylic acid represented by the following formula (II).

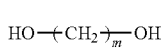

(I)

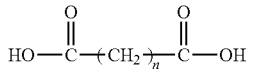

(II)

(In the formulas, n and m represent integers that are at least 4 and not more than 10.)

Such a condensation polymer is preferably incorporated in the crystalline polyester resin B at least 60 mass % and not more than 100 mass % as the total amount and more preferably at least 90 mass % and not more than 100 mass % as the total amount.

It is known that crystalline resins generally are resins having a lower volume resistance than amorphous resins. The present inventors believe that the reason for this is as follows.

Crystalline resins generally form crystalline structures in which the molecular chains exhibit a regular arrangement, and, when viewed at the macro level, it is thought that, in the temperature region below the melting point, a state is maintained in which molecular motion is restricted. However, when viewed at the micro level, crystalline resins are not composed entirely of a crystalline structure portion, but rather are formed of a crystalline structure portion—in which the molecular chains exhibit a regular arrangement and which has a crystalline structure—and outside of this of an amorphous structure portion.

In the case of crystalline polyester resins that have a melting point in the range commonly used for toners, the glass transition temperature (Tg) of the crystalline polyester resin is substantially below room temperature, and as a consequence it is thought that, when viewed at the micro level, the amorphous structure portion is engaging in molecular motion even at room temperature. It is thought that in an environment in which such a resin has a high molecular mobility, charge transfer can occur via, for example, the ester bond, which is a polar group, and the volume resistance of the resin is reduced as a result.

Accordingly, it is hypothesized that the volume resistance can be raised by keeping the concentration of the polar ester group low, and as a consequence the use is preferred of a crystalline polyester resin that has a low ester group concentration.

The value of the ester group concentration is governed primarily by the type of diol component and dicarboxylic acid component, and a low value can be engineered by selecting for each a species that has a large number of carbons.

The crystalline polyester resin B has a weight-average molecular weight (Mw), as measured by gel permeation chromatography, preferably of at least 5,000 and not more than 50,000 and more preferably of at least 5,000 and not more than 20,000.

The low-temperature fixability and the strength of the resin in the toner can be further improved by having the weight-average molecular weight (Mw) of the crystalline polyester resin B satisfy the indicated range.

The weight-average molecular weight (Mw) of the crystalline polyester resin B can be readily controlled through various known conditions in the production of crystalline polyester resins.

The weight-average molecular weight (Mw) of the crystalline polyester resin B is measured as follows using gel permeation chromatography (GPC).

Special grade 2,6-di-t-butyl-4-methylphenol (BHT) is added at a concentration of 0.10 mass % to o-dichlorobenzene for gel chromatography and dissolution is performed at room temperature. The crystalline polyester resin and this BHT-containing o-dichlorobenzene are introduced into a sample vial and heating is carried out on a hot plate set to 150° C. to dissolve the crystalline polyester resin.

Once the crystalline polyester resin has dissolved, this is introduced into a preheated filter unit and is placed in the main unit. The material passing through the filter unit is used as the GPC sample.

The sample solution is adjusted to a concentration of approximately 0.15 mass %.

The measurement is performed under the following conditions using this sample solution.

instrument: HLC-8121GPC/HT (Tosoh Corporation)
detector: high-temperature RI
column: TSKgel GMHHR-H HT×2 (Tosoh Corporation)
temperature: 135.0° C.
solvent: o-dichlorobenzene for gel chromatography (with the addition of BHT at 0.10 mass %)
flow rate: 1.0 mL/min
injection amount: 0.4 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the crystalline polyester resin.

The melting point of the crystalline polyester resin B is preferably at least 50° C. and not more than 100° C. from the standpoint of the low-temperature fixability and storability. The low-temperature fixability is further improved by having the melting point be not more than 100° C. In addition, the low-temperature fixability is still further improved by having the melting point be not more than 90° C. A declining trend is assumed by the storability when, on the other hand, the melting point is lower than 50° C.

The melting point of crystalline polyester resins can be measured using a scanning differential calorimeter (DSC).

Specifically, at least 0.01 g and not more than 0.02 g of the sample is exactly weighed into an aluminum pan and the DSC curve is obtained by heating from 0° C. to 200° C. at a ramp rate of 10° C./min.

The peak temperature of the melting endothermic peak in the obtained DSC curve is taken to be the melting point.

The melting point of the crystalline polyester resin present in the toner can also be measured by the same procedure. When this is done, a melting point may also be observed for the release agent present in the toner. The melting point of the release agent may be distinguished from the melting point of the crystalline polyester resin by extracting the release agent from the toner using Soxhlet extraction and hexane for the solvent; carrying out differential scanning calorimetric measurement on the release agent alone using the method described above; and comparing the obtained melting point with the melting point of the toner.

The content of the crystalline polyester resin B in the toner particle is preferably at least 5 mass % and not more than 30 mass % and more preferably at least 10 mass % and not more than 20 mass %.

By combining the crystalline polyester resin B with the hybrid resin A, an excellent low-temperature fixability can be exhibited even while reducing the content of the crystalline polyester resin B. As a result, an excellent low-temperature fixability is exhibited even at a content for the crystalline polyester resin B of 5 mass %.

In addition, contact between domains of the low-resistance crystalline resin can be better prevented by having the content of the crystalline polyester resin B be not more than 30 mass %. As a consequence, the formation of charge escape pathways in the matrix of the high-resistance amorphous resin can be substantially prevented and a toner having an even better charging performance can then be obtained.

The crystalline polyester resin B is preferably at least 90 mass % and more preferably at least 95 mass % of the crystalline resin present in the toner particle.

SP Value

The SP value refers to the solubility parameter value, and a higher compatibility occurs as values are nearer to one another. An excellent low-temperature fixability can be obtained by having the SP values for the polyester segment and polypropylene glycol segment of the hybrid resin A and for the crystalline polyester resin B satisfy $|SPh-SPc|-|SPp-SPc|<1$. $|SPh-SPc|-|SPp-SPc|$ is preferably not more than 0.9 and is more preferably equal to or less than 0.0. On the other hand, while the lower limit is not particularly limited, it is preferably equal to or greater than −1.0. More preferably, an even better low-temperature fixability can be obtained by adopting $|SPh-SPc|<|SPp-SPc|$.

The previously described structures are preferably adopted for the polyester segment of the hybrid resin A and for the crystalline polyester resin B in order to control into the indicated SP value range.

The SP value SPh of the polyester segment is preferably at least 20.0 and not more than 24.5 and is more preferably at least 22.5 and not more than 23.3.

The SP value SPc of the crystalline polyester resin B is preferably at least 19.1 and not more than 22.9 and is more preferably at least 19.4 and not more than 20.9.

The aforementioned SP values can be determined using Fedors' equation. Here, for the values of Δei and Δvi reference was made to the energies of vaporization and molar volumes (25° C.) of atoms and atomic groups in Tables 3-9 of "Basic Coating Science", pp. 54-57, 1986 (Maki Shoten Publishing).

$$\delta i=[Ev/V]^{(1/2)}=[\Delta ei/\Delta vi]^{(1/2)} \quad \text{equation}$$

Ev: energy of vaporization

V: molar volume

Δei: energy of vaporization of the atoms or atomic groups of component i

Δvi: molar volume of the atoms or atomic groups of component i

For example, a crystalline polyester formed from nonanediol and sebacic acid is constructed of (—COO)×2+(—$CH_2$)×17 atomic groups as the repeat unit, and its calculated SP value is determined from the following equation.

$$\delta i=[\Delta ei/\Delta vi]^{(1/2)}=[\{(1800)\times 2+(4940)\times 17\}/\{(18)\times 2+(16.1)\times 17\}]^{(1/2)}$$

The SP value (δi) then evaluates to 19.7 $(J/cm^3)^{(1/2)}$.

The constituent materials of the toner that are used on an optional basis are described in the following.

Amorphous Resin

The toner particle may contain an amorphous resin other than the hybrid resin A. This amorphous resin should be a resin that does not exhibit crystallinity, but is not otherwise particularly limited. The use of an amorphous polyester resin is preferred because compatibility with the hybrid resin A and the crystalline polyester resin B is preferred.

The amorphous polyester resin is not particularly limited and can be exemplified by amorphous polyester resins obtained by the condensation polymerization of an alcohol component with a carboxylic acid component.

The alcohol component can be specifically exemplified by the following:

alkylene oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, and also ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and derivatives of the preceding. These derivatives should provide the same resin structure by the aforementioned condensation polymerization, but are not otherwise particularly limited. Examples here are derivatives provided by the esterification of the alcohol component.

The carboxylic acid component, on the other hand, can be exemplified by the following:

aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acid substituted by an alkyl group or alkenyl group having at least 6 and not more than 18 carbons, and their anhydrides; unsaturated dicarboxylic acids such as fumaric acid, maleic acid, and citraconic acid, and their anhydrides; polybasic carboxylic acids such as trimellitic acid, pyromellitic acid, and benzophenonetetracarboxylic acid, and their anhydrides; and derivatives of the preceding. The derivatives should be dicarboxylic acid derivatives that provide the same resin structure by the aforementioned condensation polymerization, but are not otherwise particularly limited. Examples here are derivatives provided by the methyl esterification or ethyl esterification of the carboxylic acid component and derivatives provided by conversion of the carboxylic acid component into the acid chloride.

Preferred examples of the amorphous polyester resin are resins obtained by the condensation polymerization of an alcohol component that contains a compound selected from the group consisting of bisphenols represented by the following formula (1) and their derivatives, with a carboxylic acid component that contains a compound selected from the group consisting of dibasic and higher basic carboxylic acids and their derivatives (for example, fumaric acid, maleic acid, maleic anhydride, phthalic acid, terephthalic acid, trimellitic acid, and pyromellitic acid).

(1)

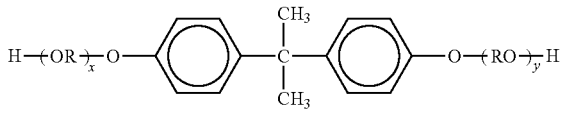

(In the formula, R represents an ethylene or propylene group; x and y are each integers equal to or greater than 1; and the average value of x+y is at least 2 and not more than 10.)

Another example is resin obtained by the condensation polymerization of an alcohol component containing a compound selected from the group consisting of bisphenols represented by the following formula (2) and derivatives thereof, with a carboxylic acid component containing a compound selected from the group consisting of aromatic dicarboxylic acids and derivatives thereof (for example, isophthalic acid, terephthalic acid).

The compound selected from the group consisting of bisphenols represented by formula (2) and derivatives thereof is contained in the alcohol component at preferably at least 50 mol % for the total amount and at more preferably at least 90 mol % for the total amount.

Moreover, this resin is preferably contained in the amorphous resin at preferably at least 25 mass % as the total amount and at more preferably at least 50 mass % as the total amount.

(2)

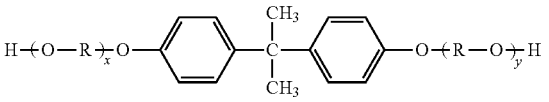

(In the formula, R is —$CH_2$—$CH(CH_3)$—; x and y are each integers equal to or greater than 1; and the average value of x+y is at least 2 and not more than 10.)

The glass transition temperature of the amorphous resin is preferably at least 30° C. and not more than 80° C.

The storability is improved when the glass transition temperature is at least 30° C.

In addition, in high-temperature, high-humidity environments, the charging performance is also improved due to a suppression of the reduction in resistance caused by the molecular motion of the resin.

The low-temperature fixability is improved, on the other hand, when the glass transition temperature is not more than 80° C.

The glass transition temperature is more preferably at least 40° C. from the standpoint of the storability. The glass transition temperature, on the other hand, is more preferably not more than 70° C. from the standpoint of the low-temperature fixability.

The softening temperature (Tm) of the amorphous resin is preferably at least 70° C. and not more than 150° C., more preferably at least 80° C. and not more than 140° C., and even more preferably at least 80° C. and not more than 130° C.

When the softening temperature (Tm) is in the indicated range, an excellent coexistence between the coagulation resistance and offset resistance is engineered and in addition a low degree of penetration by the melted toner components into the paper is obtained during the high temperatures during fixation and an excellent surface smoothness is obtained.

The softening temperature (Tm) of the amorphous resin can be measured using a "Flowtester CFT-500D Flow Property Evaluation Instrument" (Shimadzu Corporation), which is a constant-load extrusion-type capillary rheometer.

The CFT-500D is an instrument in which, while a constant load is applied by a piston from the top, the measurement sample filled in a cylinder is heated and melted and is extruded from a capillary orifice at the bottom of the cylinder and during this process a flow curve is graphed from the piston stroke (mm) and the temperature (° C.).

The "melting temperature by the ½ method", as described in the manual provided with the "Flowtester CFT-500D Flow Property Evaluation Instrument", is used as the softening temperature (Tm) in the present invention.

The melting temperature by the ½ method is determined as follows.

First, ½ of the difference between the piston stroke at the completion of outflow (outflow completion point, designated as Smax) and the piston stroke at the start of outflow (lowest point, designated as Smin) is determined (this is designated as X, where X=(Smax−Smin)/2). The temperature of the flow curve when the piston stroke reaches the sum of X and Smin is taken to be the melting temperature by the ½ method.

The measurement sample used is prepared by subjecting 1.2 g of the amorphous resin to compression molding for 60 seconds at 10 MPa in a 25° C. environment using a tablet compression molder (for example, the NT-100H Standard Manual Newton Press, NPa System Co., Ltd.) to provide a cylindrical shape with a diameter of 8 mm.

The specific measurement procedure is carried out according to the manual provided with the instrument.

The measurement conditions with the CFT-500D are as follows.

test mode: ramp-up method
start temperature: 60° C.
saturated temperature: 200° C.
measurement interval: 1.0° C.
ramp rate: 4.0° C./min
piston cross section area: 1.000 $cm^2$
test load (piston load): 5.0 kgf
preheating time: 300 seconds
diameter of die orifice: 1.0 mm
die length: 1.0 mm The amorphous resin preferably has an ionic group, i.e., a carboxylic acid group, sulfonic acid group, or amino group, in the resin skeleton, and the incorporation of a carboxylic acid group is more preferred.

The acid value of the amorphous resin is preferably 3 mg KOH/g to 35 mg KOH/g and is more preferably 8 mg KOH/g to 25 mg KOH/g.

An excellent charge quantity is obtained, in both high-humidity environments and low-humidity environments, when the acid value of the amorphous resin is in the indicated range. The acid value is the number of milligrams of potassium hydroxide required to neutralize, e.g., the free fatty acid, resin acid, and so forth, present in 1 g of a sample. Measurement according to JIS K 0070 is carried out for the measurement method.

The content of the amorphous resin in the toner particle is preferably 5 mass % to 70 mass %.

Colorant

A colorant may be used in the toner particle. This colorant can be exemplified as follows.

The black colorants can be exemplified by carbon black and by black colorants obtained by color mixing using a yellow colorant, magenta colorant, and cyan colorant to give a black color. A pigment may be used by itself for the colorant, but the enhanced sharpness provided by the co-use of a dye with a pigment is more preferred from the standpoint of the image quality of full-color images.

Pigments for magenta toners can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; and C. I. Vat Red 1, 2, 10, 13, 15, 23, 29, and 35.

Dyes for magenta toners can be exemplified by the following: oil-soluble dyes such as C. I. Solvent Red 1, 3, 8, 23, 24, 25, 27, 30, 49, 81, 82, 83, 84, 100, 109, and 121; C. I. Disperse Red 9; C. I. Solvent Violet 8, 13, 14, 21, and 27; and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28.

Pigments for cyan toners can be exemplified by the following: C. I. Pigment Blue 2, 3, 15:2, 15:3, 15:4, 16, and 17; C. I. Vat Blue 6; C. I. Acid Blue 45; and copper phthalocyanine pigments having at least 1 and not more than 5 phthalimidomethyl groups substituted on the phthalocyanine skeleton.

C. I. Solvent Blue 70 is an example of a dye for cyan toners.

Pigments for yellow toners can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185 and by C. I. Vat Yellow 1, 3, and 20.

C. I. Solvent Yellow 162 is an example of a dye for yellow toners.

A single one of these colorants may be used or a mixture may be used and these colorants may also be used in a solid solution state.

The colorant may be selected considering the hue angle, chroma, lightness, lightfastness, OHP transparency, and dispersibility in the toner particle.

The colorant content is preferably 1 to 20 mass parts per 100 mass parts of the resin component that constitutes the toner particle.

Release Agent

The toner particle may contain a release agent, and the release agent can be exemplified by the following:

low molecular weight polyolefins such as polyethylene; silicones having a melting point (softening point) under heating; fatty acid amides such as oleamide, erucamide, ricinoleamide, and stearamide; ester waxes such as stearyl stearate; plant waxes such as carnauba wax, rice wax, candelilla wax, Japan wax, and jojoba oil; animal waxes such as bees wax; mineral and petroleum waxes such as montan wax, ozokerite, ceresin, paraffin waxes, microcrystalline wax, Fischer-Tropsch waxes, and ester waxes; and modifications of the preceding.

The content of the release agent is preferably 1 to 25 mass parts per 100 mass parts of the resin component that constitutes the toner particle.

Toner Production Method

A known toner production method can be adopted, e.g., the suspension polymerization method, kneading pulverization method, emulsion aggregation method, and dissolution suspension method, but there is no limitation to any of these methods.

Specific examples of the toner production method are provided below using the kneading pulverization method and emulsion aggregation method, but there is no limitation to or by these.

Kneading Pulverization Method

In the kneading pulverization method, the hybrid resin A and crystalline polyester resin B that are the constituent materials of the toner and the amorphous resin, release agent, colorant, and other additives that are added on an optional basis are first thoroughly mixed and are melt-kneaded using a known heated kneader such as a heated roll or kneader (kneading step). This is followed by mechanical pulverization to a desired particle diameter (pulverization step) and as necessary classification in order to establish a desired particle size distribution (classification step) and obtain the toner particle.

Kneading Step

Melt-kneading can be carried out using a known heated kneader such as a heated roll or kneader. This kneading step is preferably preceded by a thorough mixing of the toner constituent materials using a mixer.

The mixer can be exemplified by the Henschel mixer (Mitsui Mining Co., Ltd.); Supermixer (Kawata Mfg Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The heated kneader can be exemplified by the KRC Kneader (Kurimoto, Ltd.); Buss Ko-Kneader (Buss AG); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Mfg., Inc.); Kneadex (Mitsui Mining Co., Ltd.); Model MS pressure kneader and Kneader-Ruder (Moriyama Works); and Banbury mixer (Kobe Steel, Ltd.).

Pulverization Step

The pulverization step is a step in which the kneaded material yielded by the kneading step is cooled until a hardness that supports pulverization is reached and in which a mechanical pulverization is then carried out, using a known pulverizer such as an impact plate-type jet mill, fluid bed jet mill, or rotary mechanical mill, until the toner particle diameter is reached. Viewed from the standpoint of the pulverization efficiency, a fluid bed jet mill is desirably used as the pulverizer.

The pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Classification Step

The classification step is a step of classifying the finely pulverized material yielded by the pulverization step to obtain a toner particle having a desired particle size distribution.

A known apparatus, e.g., an air classifier, internal classifier, and sieve-type classifier, can be used as the classifier used for classification. Specific examples are Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa & Co., Ltd.).

As necessary, inorganic fine particles of, e.g., silica, alumina, titania, calcium carbonate, and so forth, and/or resin fine particles of, e.g., vinyl resin, polyester resin, silicone resin, and so forth, may be added to the obtained toner particle through the application of shear force in a dry state. These inorganic fine particles and resin fine particles function as external additives, e.g., flowability auxiliaries, cleaning auxiliaries, and so forth.

Emulsion Aggregation Method

The emulsion aggregation method is a method in which an aqueous dispersion is prepared in advance of fine particles comprising the constituent materials of the toner particle, wherein these fine particles are sufficiently smaller than the target particle diameter; these fine particles are aggregated in the aqueous dispersion until the toner particle diameter is reached; and melt-adhesion of the resin is then induced by heating to produce the toner.

That is, the toner is produced in the emulsion aggregation method through a dispersion step of producing a dispersion of fine particles comprising the toner particle constituent materials; an aggregation step of aggregating the fine particles comprising the toner particle constituent materials, with control of the particle diameter until the particle diameter of the toner is reached; a fusion step in which the resin present in the resulting aggregate particle is melt-adhered; and an ensuing cooling step.

Dispersion Step

Aqueous dispersions of hybrid resin A fine particles, crystalline polyester resin B fine particles, and fine particles of the optionally used amorphous resin can be prepared by known methods, but there are no limitations on these procedures. The known methods can be exemplified by emulsion polymerization methods; self-emulsification methods; phase inversion emulsification methods, in which the resin is emulsified by the addition of an aqueous medium to a solution of the resin dissolved in an organic solvent; and forced emulsification methods, in which the resin is forcibly emulsified by a high-temperature treatment in an aqueous medium without the use of organic solvent.

Specifically, the hybrid resin A or crystalline polyester resin B is dissolved in an organic solvent in which it is soluble and a surfactant and/or basic compound is added. Then, while stirring with, for example, a homogenizer, an aqueous medium is gradually added and resin fine particles are thereby separated. This is followed by removal of the solvent by heating or under reduced pressure to produce an aqueous dispersion of resin fine particles. Any organic solvent that can dissolve the aforementioned resin can be used for the organic solvent used here, but the use of an organic solvent that forms a uniform phase with water, e.g., tetrahydrofuran, is preferred from the standpoint of suppressing the formation of coarse powder.

There are no particular limitations on the surfactant that may be used during this emulsification, and the surfactant can be exemplified by anionic surfactants such as sulfate ester salts, sulfonate salts, carboxylic acid salts, phosphate esters, soaps, and so forth; cationic surfactants such as amine salts, quaternary ammonium salts, and so forth; and nonionic surfactants such as polyethylene glycol types, ethylene oxide adducts of alkylphenols, polyhydric alcohol types, and so forth. A single one of these surfactants may be used by itself or two or more may be used in combination.

The basic compound used in this emulsification can be exemplified by inorganic bases such as sodium hydroxide, potassium hydroxide, and so forth, and by organic bases such as ammonia, triethylamine, trimethylamine, dimethylaminoethanol, diethylaminoethanol, and so forth. A single one of these bases may be used by itself or two or more may be used in combination.

The 50% particle diameter (d50) on a volume basis of the hybrid resin A-containing resin fine particles is preferably 0.05 to 1.0 μm and more preferably 0.05 to 0.4 μm.

A toner having the preferred volume-average particle diameter of 4.0 to 7.0 μm is readily obtained by adjusting the 50% particle diameter (d50) on a volume basis into the indicated range.

The 50% particle diameter (d50) on a volume basis of the crystalline polyester resin B fine particles is preferably 0.05 to 0.5 μm and more preferably 0.05 to 0.3 μm from the standpoint of suppressing the production of coarse particles in the aggregation step.

A dynamic light-scattering particle distribution analyzer (Nanotrac UPA-EX150, Nikkiso Co., Ltd.) may be used for measurement of the 50% particle diameter (d50) on a volume basis.

The aqueous dispersion of colorant fine particles that may be used on an optional basis can be prepared by the known method provided as an example herebelow, but there is no limitation to this procedure.

This preparation can be carried out by mixing the colorant, an aqueous medium, and a dispersing agent using a mixer such as a known stirrer, emulsifying apparatus, or disperser. The dispersing agent used here can be a known dispersing agent, i.e., a surfactant or polymeric dispersing agent.

While either dispersing agent, i.e., surfactant or polymeric dispersing agent, can be removed in the washing step described below, surfactant is preferred from the standpoint of the washing efficiency. Among surfactants, anionic surfactants and nonionic surfactants are more preferred.

The surfactant can be exemplified by anionic surfactants such as sulfate ester salts, sulfonate salts, phosphate esters, soaps, and so forth; cationic surfactants such as amine salts, quaternary ammonium salts, and so forth; and nonionic surfactants such as polyethylene glycol types, ethylene oxide adducts of alkylphenols, polyhydric alcohol types, and so forth. Among these, nonionic surfactants and anionic surfactants are preferred. In addition, a nonionic surfactant may be used in combination with an anionic surfactant. A single one of these surfactants may be used by itself or two or more may be used in combination.

The amount of the dispersing agent, per 100 mass parts of the colorant, is preferably at least 1 mass part and not more than 20 mass parts and, from the standpoint of the coexistence of the dispersion stability with the washing efficiency, at least 2 mass parts and not more than 10 mass parts is more preferred.

The content of the colorant in the colorant fine particle aqueous dispersion is not particularly limited, but 1 to 30 mass % with reference to the total mass of the colorant fine particle aqueous dispersion is preferred.

With regard to the dispersed particle diameter of the colorant fine particles in the aqueous dispersion, the 50% particle diameter (d50) on a volume basis is preferably not greater than 0.5 μm based on a consideration of the dispersity of the colorant in the ultimately obtained toner. For this same reason, the 90% particle diameter (d90) on a volume basis is also preferably not greater than 2 μm. The dispersed particle diameter of the colorant fine particles dispersed in the aqueous medium may be measured using a dynamic light-scattering particle distribution analyzer (Nanotrac UPA-EX150, Nikkiso Co., Ltd.).

The mixer, e.g., a known stirrer, emulsifying apparatus, or disperser, used to disperse the colorant in the aqueous medium can be exemplified by ultrasound homogenizers, jet mills, pressurized homogenizers, colloid mills, ball mills, sand mills, and paint shakers. A single one of these may be used by itself or a combination may be used.

An aqueous dispersion of fine particles of the optionally used release agent can be prepared by a known method, as exemplified in the following, but there is no limitation to these procedures.

An aqueous dispersion of release agent fine particles can be produced by adding the release agent to a surfactant-containing aqueous dispersion and heating to at least the melting point of the release agent; dispersing into particulate form using a homogenizer capable of applying a strong shear (for example, a "Clearmix W-Motion", M Technique Co., Ltd.) or using a pressure-ejection disperser (for example, a "Gaulin Homogenizer", Gaulin Co.); and subsequently cooling below the melting point.

With regard to the dispersed particle diameter of the colorant fine particles in the aqueous dispersion, the 50% particle diameter (d50) on a volume basis is preferably at least 0.03 μm and not more than 1.0 μm and is more preferably at least 0.1 μm and not more than 0.5 μm. Coarse particles of 1 μm and above are preferably not present.

By adopting this range for the dispersed particle diameter of the release agent fine particles, an excellent elution of the release agent during fixing is obtained and the hot offset temperature can then be raised, and it also becomes possible to suppress the production of filming at the photosensitive member.

The dispersed particle diameter of the release agent fine particles dispersed in the aqueous medium may be measured using a dynamic light-scattering particle distribution analyzer (Nanotrac UPA-EX150, Nikkiso Co., Ltd.).

Aggregation Step

In the aggregation step, a mixture is prepared by mixing the aforementioned aqueous dispersion of hybrid resin A fine particles with the aqueous dispersion of the crystalline polyester resin B fine particles and optionally with the aqueous dispersion of amorphous resin fine particles, aqueous dispersion of release agent fine particles, and aqueous dispersion of colorant fine particles. The fine particles contained in the thusly prepared mixture are then aggregated to form aggregate particles having a target particle diameter. Here, the formation of aggregate particles—in which the resin fine particles, colorant fine particles, and release agent fine particles are aggregated preferably is brought about by the addition of an aggregating agent with mixing and as necessary by the suitable application of heating and/or mechanical force.

An aggregating agent containing an at least divalent metal ion is preferably used as this aggregating agent.

Aggregating agents that contain an at least divalent metal ion have a high aggregative power and through their addition in small amounts can ionically neutralize the acidic polar groups in the resin fine particles as well as the ionic surfactant present in the resin fine particle aqueous dispersions, the colorant fine particle aqueous dispersion, and the release agent fine particle aqueous dispersion. As a result, the resin fine particles, colorant fine particles, and release agent fine particles are aggregated through the effects of salting out and ion crosslinking.

The aggregating agent containing an at least divalent metal ion can be exemplified by at least divalent metal salts and by metal salt polymers. Specific examples are inorganic divalent metal salts such as calcium chloride, calcium nitrate, magnesium chloride, magnesium sulfate, and zinc chloride; trivalent metal salts such as iron(III) chloride, iron(III) sulfate, aluminum sulfate, and aluminum chloride; and inorganic metal salt polymers such as polyaluminum chloride, polyaluminum hydroxide, and calcium polysulfide; however, there is no limitation to the preceding. A single one of these may be used by itself or two or more may be used in combination.

The aggregating agent may be added in the form of the dry powder or in the form of the aqueous solution prepared by dissolution in an aqueous medium; however, addition in the form of the aqueous solution is preferred in order to bring about a uniform aggregation.

In addition, the addition and mixing of the aggregating agent is preferably carried out at a temperature at or below the glass transition temperature of the resin present in the mixture. A uniform aggregation is developed by executing mixing under this temperature condition. The aggregating agent can be mixed into the mixture using a known mixing apparatus, such as a homogenizer or a mixer.

There are no particular limitations on the average particle diameter of the aggregate particles formed in this aggregation step, but generally control is preferably exercised so as to make it about the same as the average particle diameter of the toner particle that will be ultimately obtained. The particle diameter of the aggregate particles can be readily controlled through judicious adjustment of the temperature, solids concentration, concentration of the aggregating agent, and stirring conditions.

A toner particle having a core/shell structure can be produced by the addition—to the dispersion of aggregate particles provided by the aggregation step—of resin fine particles for forming a shell phase; attaching the resin fine particles to the surface of the aggregate particles; and inducing fusion. The resin fine particles added here in order to form the shell phase may be fine particles of a resin having the same structure as the resin contained in the aggregate particles or may be fine particles of a resin that has a different structure.

Fusion Step

In the fusion step, an aggregation inhibitor is added, under the same stirring as in the aggregation step, to the aggregate particle-containing dispersion provided by the aggregation step. This aggregation inhibitor can be exemplified by basic compounds that shift the equilibrium for the acidic polar groups in the resin fine particles to the dissociation side and thereby stabilize the aggregate particles, and by chelating agents that stabilize the aggregate particles through the partial dissociation of the ion crosslinks between the acidic polar groups in the resin fine particles and the metal ion aggregating agent, with the formation of coordination bonds with the metal ion. Chelating agents, which have the greater aggregation-inhibiting effect, are preferred therebetween.

After the state of dispersion of the aggregate particles in the dispersion has been stabilized by the action of the aggregation inhibitor, fusion of the aggregate particles is performed by heating to at least the glass transition temperature of the hybrid resin A and the amorphous resin used on an optional basis.

The chelating agent may be a known water-soluble chelating agent but is not otherwise particularly limited. Specific examples are oxycarboxylic acids such as tartaric acid, citric acid, and gluconic acid and their sodium salts, as well as iminodiacetic acid (IDA), nitrilotriacetic acid (NTA), and ethylenediaminetetraacetic acid (EDTA) and their sodium salts.

By coordinating to the metal ion of the aggregating agent present in the dispersion of the aggregate particles, the chelating agent can convert the environment in this dispersion from an electrostatically unstable, readily aggregative state to an electrostatically stable state in which additional aggregation is suppressed. As a consequence of this, additional aggregation of the aggregate particles in the dispersion can be suppressed and the aggregate particles can be stabilized.

This chelating agent is preferably an organic metal salt that has at least tribasic carboxylic acid because such a chelating agent is effective even at small amounts of addition and also provides a toner particle having a sharp particle size distribution.

Viewed from the perspective of having the washing efficiency coexist with stabilization from the aggregated state, the quantity of addition for the chelating agent, expressed per 100 mass parts of the resin particles, is preferably at least 1 mass part and not more than 30 mass parts and is more preferably at least 2.5 mass parts and not more than 15 mass parts.

Toner particles can then be obtained by washing, filtration, drying, and so forth of the particles yielded by the fusion treatment.

The resulting toner particles may be used as such as toner. The following may be added on an optional basis to the toner particles in the dry state with the application of shear force: inorganic fine particles, e.g., of silica, alumina, titania, calcium carbonate, and so forth; and/or resin fine particles, e.g., of vinyl resin, polyester resin, silicone resin, and so forth. These inorganic fine particles and resin fine particles function as external additives, e.g., flowability auxiliaries, cleaning auxiliaries, and so forth.

EXAMPLES

The present invention is described in greater detail hereebelow using examples and comparative examples, but the embodiments of the present invention are not limited to or by these. Unless specifically indicated otherwise, the number of parts and % in the examples and comparative examples are on a mass basis in all instances.

| Amorphous Resin Fine Particle 1 Production | |
|---|---|
| tetrahydrofuran (Wako Pure Chemical Industries, Ltd.) | 600 parts |
| hybrid resin A-1 (composition (mol parts) (polyoxypropylene(2.2)-2,2-bis(4-hydroxyphenyl)propane:terephthalic acid:polypropylene glycol (number-average molecular weight = 400) = 75:100:25), SP value of the polyester segment = 22.5, SP value of the polypropylene glycol segment = 17.7, Mn = 3,460, glass transition temperature (Tg) = 21° C., content of the polypropylene glycol segment = 12.5 mol %) | 60 parts |
| polyester resin C-1 (composition (mol parts) (polyoxypropylene(2.2)-2,2-bis(4-hydroxyphenyl)propane:isophthalic acid:terephthalic acid = 100:50:50), Mn = 4,600, Mw = 16,500, Mp = 10,400, Tm = 122° C., Tg = 70° C., acid value = 13 mg KOH/g) | 90 parts |
| polyester resin C-2 (composition (mol parts) (polyoxypropylene(2.2)-2,2-bis(4-hydroxyphenyl)propane:polyoxyethylene(2.0)-2,2-bis(4-hydroxyphenyl)propane:terephthalic acid:dodecylsuccinic acid:trimellitic acid = 33:17:24:20:6), Mn = 4,600, Mw = 62,000, Mp = 8,500, Tm = 120° C., Tg = 56° C., acid value = 11 mg KOH/g) | 120 parts |
| anionic surfactant (Neogen RK, DKS Co. Ltd.) | 1.4 parts |

The preceding were mixed followed by stirring for 12 hours to dissolve the resins.

This was followed by the addition of 54.5 parts of 1 mol/L aqueous ammonia and stirring at 4,000 rpm using a T. K. Robomix ultrahigh speed stirrer (Primix Corporation).

800 parts of deionized water was also added at a rate of 8 g/min to separate resin fine particles. This was followed by removal of the tetrahydrofuran using an evaporator to obtain a dispersion of the amorphous resin fine particle 1.

The 50% particle diameter (d50) on a volume basis of the amorphous resin fine particle 1 was 0.13 μm when measured using a dynamic light-scattering particle distribution analyzer (Nanotrac, Nikkiso Co., Ltd.).

Amorphous Resin Fine Particle 2 Production

A dispersion of an amorphous resin fine particle 2 was obtained proceeding as in Amorphous Resin Fine Particle 1 Production, but changing the hybrid resin A-1 to hybrid resin A-2 (composition (mol parts) (polyoxypropylene(2.2)-2,2-bis(4-hydroxyphenyl)propane:fumaric acid:polypropylene glycol (number-average molecular weight=400)=75:100:25), SP value of the polyester segment=21.4, SP value of the polypropylene glycol segment=17.7, Mn=3,460, glass transition temperature (Tg)=8° C., content of the polypropylene glycol segment=12.5 mol %). The 50% particle diameter (d50) on a volume basis of the obtained amorphous resin fine particle 2 was 0.13 μm.

Amorphous Resin Fine Particle 3 Production

A dispersion of an amorphous resin fine particle 3 was obtained proceeding as in Amorphous Resin Fine Particle 1 Production, but changing the amounts of the amorphous resins to hybrid resin A-1=111.8 parts, polyester resin C-1=67.8 parts, and polyester resin C-2=90.4 parts. The 50% particle diameter (d50) on a volume basis of the obtained amorphous resin fine particle 3 was 0.15 μm.

Amorphous Resin Fine Particle 4 Production

A dispersion of an amorphous resin fine particle 4 was obtained proceeding as in Amorphous Resin Fine Particle 1 Production, but changing the amounts of the amorphous resins to hybrid resin A-1=186.3 parts, polyester resin C-1=35.9 parts, and polyester resin C-2=47.8 parts. The 50% particle diameter (d50) on a volume basis of the obtained amorphous resin fine particle 4 was 0.12 μm.

Amorphous Resin Fine Particle 5 Production

A dispersion of an amorphous resin fine particle 5 was obtained proceeding as in Amorphous Resin Fine Particle 1 Production, but changing the amounts of the amorphous resins to hybrid resin A-1=37.3 parts, polyester resin C-1=99.7 parts, and polyester resin C-2=133.0 parts. The 50% particle diameter (d50) on a volume basis of the obtained amorphous resin fine particle 5 was 0.13 μm.

Amorphous Resin Fine Particle 6 Production

A dispersion of an amorphous resin fine particle 6 was obtained proceeding as in Amorphous Resin Fine Particle 1 Production, but changing the amounts of the amorphous resins to hybrid resin A-1=204.9 parts, polyester resin C-1=27.9 parts, and polyester resin C-2=37.2 parts. The 50% particle diameter (d50) on a volume basis of the obtained amorphous resin fine particle 6 was 0.11 μm.

Amorphous Resin Fine Particle 7 Production

A dispersion of an amorphous resin fine particle 7 was obtained proceeding as in Amorphous Resin Fine Particle 1 Production, but changing the amounts of the amorphous resins to hybrid resin A-1=18.6 parts, polyester resin C-1=107.7 parts, and polyester resin C-2=143.7 parts. The 50% particle diameter (d50) on a volume basis of the obtained amorphous resin fine particle 7 was 0.14 μm.

Amorphous Resin Fine Particle 8 Production

A dispersion of an amorphous resin fine particle 8 was obtained proceeding as in Amorphous Resin Fine Particle 1 Production, but changing the hybrid resin A-1 to hybrid resin A-3 (composition (mol parts) (polyoxypropylene(2.2)-2,2-bis(4-hydroxyphenyl)propane:terephthalic acid:polypropylene glycol (number-average molecular weight=400)=50:100:50), SP value of the polyester segment=22.5, SP value of the polypropylene glycol segment=17.7, Mn=3,460, glass transition temperature (Tg)=10° C., content of the polypropylene glycol segment=25 mol %). The 50% particle diameter (d50) on a volume basis of the obtained amorphous resin fine particle 8 was 0.12 μm.

Amorphous Resin Fine Particle 9 Production

A dispersion of an amorphous resin fine particle 9 was obtained proceeding as in Amorphous Resin Fine Particle 1 Production, but changing the hybrid resin A-1 to hybrid resin A-4 (composition (mol parts) (polyoxypropylene(2.2)-2,2-bis(4-hydroxyphenyl)propane:terephthalic acid:polypropylene glycol (number-average molecular weight=3,200)=75:100:25), SP value of the polyester segment=22.5, SP value of the polypropylene glycol segment=17.7, Mn=1,970, glass transition temperature (Tg)=19° C., content of the polypropylene glycol segment=12.5 mol %). The 50% particle diameter (d50) on a volume basis of the obtained amorphous resin fine particle 9 was 0.11 μm.

Amorphous Resin Fine Particle 10 Production

A dispersion of an amorphous resin fine particle 10 was obtained proceeding as in Amorphous Resin Fine Particle 1 Production, but changing the hybrid resin A-1 to hybrid resin A-5 (composition (mol parts) (polyoxypropylene(2.2)-2,2-bis(4-hydroxyphenyl)propane:terephthalic acid:polyethylene glycol (number-average molecular weight=400)=75:100:25), SP value of the polyester segment=22.5, SP value of the polyethylene glycol segment=19.2, Mn=2,330, glass transition temperature (Tg)=19° C.). The 50% particle diameter (d50) on a volume basis of the obtained amorphous resin fine particle 10 was 0.12 μm.

Amorphous Resin Fine Particle 11 Production

A dispersion of an amorphous resin fine particle 11 was obtained proceeding as in Amorphous Resin Fine Particle 1 Production, but changing the hybrid resin A-1 to hybrid resin A-6 (composition (mol parts) (polyoxypropylene(2.2)-2,2-bis(4-hydroxyphenyl)propane:terephthalic acid:polypropylene glycol (number-average molecular weight=290)=75:100:25), SP value of the polyester segment=22.5, SP value of the polypropylene glycol segment=17.7, Mn=1,970, glass transition temperature (Tg)=19° C., content of the polypropylene glycol segment=12.5 mol %). The 50% particle diameter (d50) on a volume basis of the obtained amorphous resin fine particle 11 was 0.13 μm.

| Amorphous Resin Fine Particle 12 Production | |
|---|---|
| tetrahydrofuran (Wako Pure Chemical Industries, Ltd.) | 600 parts |
| polyester resin C-3 (composition (mol parts) (polyoxypropylene(2.2)-2,2-bis(4-hydroxyphenyl)propane:polyoxyethylene(2.0)-2,2-bis(4-hydroxyphenyl)propane:terephthalic acid:fumaric acid = 25:75:30:70), Mn = 3,200, Mw = 10,600, Mp = 8,500, Tm = 96° C., Tg = 52° C., acid value = 12 mg KOH/g) | 270 parts |
| anionic surfactant (Neogen RK, DKS Co. Ltd.) | 1.4 parts |

The preceding were mixed followed by stirring for 12 hours to dissolve the resin.

This was followed by the addition of 63.5 parts of 1 mol/L aqueous ammonia and stirring at 4,000 rpm using a T. K. Robomix ultrahigh speed stirrer (Primix Corporation).

800 parts of deionized water was also added at a rate of 8 g/min to separate resin fine particles. This was followed by removal of the tetrahydrofuran using an evaporator to obtain a dispersion of an amorphous resin fine particle 12. The 50% particle diameter (d50) on a volume basis of the obtained amorphous resin fine particle 12 was 0.11 μm.

Amorphous Resin Fine Particle 13 Production

A dispersion of an amorphous resin fine particle 13 was obtained proceeding as in Amorphous Resin Fine Particle 12 Production, but changing the polyester resin C-3 to polyester resin C-1 and changing the amount of addition of the 1 mol/L aqueous ammonia to 68.8 parts. The 50% particle diameter (d50) on a volume basis of the obtained amorphous resin fine particle 13 was 0.11 μm.

| Crystalline Resin Fine Particle 1 Production | |
|---|---|
| tetrahydrofuran (Wako Pure Chemical Industries, Ltd.) | 200 parts |
| crystalline polyester resin B-1 (composition (mol parts) (1,9-nonanediol:sebacic acid = 100:100), SP value = 19.7, number-average molecular weight (Mn) = 5,500, weight-average molecular weight (Mw) = 15,500, peak molecular weight (Mp) = 11,400, melting point = 78° C., acid value = 13 mg KOH/g) | 120 parts |
| anionic surfactant (Neogen RK, DKS Co. Ltd.) | 0.6 parts |

The preceding were mixed followed by heating to 50° C. and stirring for 3 hours to dissolve the resin.

This was followed by the addition of 2.7 parts of N,N-dimethylaminoethanol and stirring at 4,000 rpm using a T. K. Robomix ultrahigh speed stirrer (Primix Corporation).

360 parts of deionized water was also added at a rate of 1 g/min to separate resin fine particles. This was followed by removal of the tetrahydrofuran using an evaporator to obtain a dispersion of a crystalline resin fine particle 1.

The 50% particle diameter (d50) on a volume basis of the crystalline resin fine particle 1 was 0.30 μm when measured using a dynamic light-scattering particle distribution analyzer (Nanotrac, Nikkiso Co., Ltd.).

Crystalline Resin Fine Particle 2 Production

A dispersion of a crystalline resin fine particle 2 was obtained proceeding as in Crystalline Resin Fine Particle 1 Production, but changing the crystalline polyester resin B-1 to crystalline polyester resin B-2 (composition (mol parts) (1,6-hexanediol:sebacic acid=100:100), SP value=20.1, number-average molecular weight (Mn)=7,500, weight-average molecular weight (Mw)=27,600, peak molecular weight (Mp)=24,300, melting point=72° C., acid value=14 mg KOH/g). The 50% particle diameter (d50) on a volume basis of the obtained crystalline resin fine particle 2 was 0.25 μm.

Crystalline Resin Fine Particle 3 Production

A dispersion of a crystalline resin fine particle 3 was obtained proceeding as in Crystalline Resin Fine Particle 1 Production, but changing the crystalline polyester resin B-1 to crystalline polyester resin B-3 (composition (mol parts) (1,6-hexanediol:suberic acid=100:100), SP value=20.4, number-average molecular weight (Mn)=8,200, weight-average molecular weight (Mw)=31,700, peak molecular weight (Mp)=25,400, melting point=67° C., acid value=11 mg KOH/g). The 50% particle diameter (d50) on a volume basis of the obtained crystalline resin fine particle 3 was 0.33 μm.

Crystalline Resin Fine Particle 4 Production

A dispersion of a crystalline resin fine particle 4 was obtained proceeding as in Crystalline Resin Fine Particle 1 Production, but changing the crystalline polyester resin B-1 to crystalline polyester resin B-4 (composition (mol parts) (1,12-dodecanediol:1,12-dodecanedicarboxylic acid=100:100), SP value=19.1, number-average molecular weight (Mn)=9,000, weight-average molecular weight (Mw)=37,700, peak molecular weight (Mp)=30,500, melting point=88° C., acid value=11 mg KOH/g). The 50% particle diameter (d50) on a volume basis of the obtained crystalline resin fine particle 4 was 0.50 μm.

| Production of Colorant Fine Particles | |
|---|---|
| colorant (cyan pigment, Pigment Blue 15:3, Dainichiseika Color & Chemicals Mfg. Co., Ltd.) | 10.0 parts |

-continued

| Production of Colorant Fine Particles | |
|---|---|
| anionic surfactant (Neogen RK, DKS Co. Ltd.) | 1.5 parts |
| deionized water | 88.5 parts |

The preceding were mixed and dissolved and were dispersed for approximately 1 hour using a Nanomizer high-pressure impact-type disperser (Yoshida Kikai Co., Ltd.) to prepare a dispersion of colorant fine particles by dispersing the colorant.

The 50% particle diameter (d50) on a volume basis of the obtained colorant fine particles was 0.20 μm when measured using a dynamic light-scattering particle distribution analyzer (Nanotrac, Nikkiso Co., Ltd.).

| Production of Release Agent Fine Particles | |
|---|---|
| release agent (HNP-51, melting point = 78° C., Nippon Seiro Co., Ltd.) | 20.0 parts |
| anionic surfactant (Neogen RK, DKS Co. Ltd.) | 1.0 part |
| deionized water | 79.0 parts |

The preceding were introduced into a stirrer-equipped mixing vessel and were heated to 90° C. and subjected to a dispersion treatment for 60 minutes while circulating to a Clearmix W-Motion (M Technique Co., Ltd.) and stirring under conditions of a rotor rotation rate of 19,000 rpm and a screen rotation rate of 19,000 rpm at a shear stirring element having a rotor outer diameter of 3 cm and a clearance of 0.3 mm.

A dispersion of release agent fine particles was then obtained by cooling to 40° C. under cooling conditions of a rotor rotation rate of 1,000 rpm, a screen rotation rate of 0 rpm, and a cooling rate of 10° C./min.

The 50% particle diameter (d50) on a volume basis of the release agent fine particles was 0.15 μm when measured using a dynamic light-scattering particle distribution analyzer (Nanotrac, Nikkiso Co., Ltd.).

Example 1

| Toner Particle 1 Production | |
|---|---|
| dispersion of amorphous resin fine particle 1 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 5.8 μm and an average circularity of 0.968.

The volume-average particle diameter of the particles was measured using a Coulter Multisizer III (Beckman Coulter, Inc.) in accordance with the operating manual for the instrument. The average circularity was determined using an "FPIA-3000" flow particle image analyzer (Sysmex Corporation) and carrying out the measurement in accordance with the operating manual for the instrument.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 1 having a volume-average particle diameter of 5.4 μm. The formulation and properties of toner particle 1 are given in Tables 1 and 2.

Example 2

| Toner Particle 2 Production | |
|---|---|
| dispersion of amorphous resin fine particle 2 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 53° C. was then carried out on a heating water bath while adjusting the stirring rate as appropriate using a stirring blade such that the mixture was stirred. Holding at 53° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 5.8 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 2 having a volume-average particle diameter of 5.5 μm. The formulation and properties of toner particle 2 are given in Tables 1 and 2.

Example 3

| Toner Particle 3 Production | |
|---|---|
| dispersion of amorphous resin fine particle 1 | 347 parts |
| dispersion of crystalline resin fine particle 2 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.2 μm.

An aqueous solution of 20 parts of tetrasodium ethylenediaminetetraacetate dissolved in 380 parts of deionized water was then further added to the dispersion containing the aggregate particles, followed by heating to 83° C.

Holding was carried out for 2 hours at 83° C. to obtain toner particles having a volume-average particle diameter of approximately 6.0 μm and an average circularity of 0.967.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 3 having a volume-average particle diameter of 5.7 μm. The formulation and properties of toner particle 3 are given in Tables 1 and 2.

Example 4

| Toner Particle 4 Production | |
|---|---|
| dispersion of amorphous resin fine particle 1 | 347 parts |
| dispersion of crystalline resin fine particle 3 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 83° C.

Holding was carried out for 2 hours at 83° C. to obtain toner particles having a volume-average particle diameter of approximately 5.9 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 4 having a volume-average particle diameter of 5.7 μm. The formulation and properties of toner particle 4 are given in Tables 1 and 2.

Example 5

| Toner Particle 5 Production | |
|---|---|
| dispersion of amorphous resin fine particle 3 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.3 μm.

An aqueous solution of 20 parts of tetrasodium ethylenediaminetetraacetate dissolved in 380 parts of deionized water was then further added to the dispersion containing the aggregate particles, followed by heating to 83° C.

Holding was carried out for 2 hours at 83° C. to obtain toner particles having a volume-average particle diameter of approximately 6.2 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 5 having a volume-average particle diameter of 5.9 μm. The formulation and properties of toner particle 5 are given in Tables 1 and 2.

Example 6

| Toner Particle 6 Production | |
|---|---|
| dispersion of amorphous resin fine particle 4 | 347 parts |
| dispersion of crystalline resin fine particle 1 | 67 parts |

-continued

| Toner Particle 6 Production | |
|---|---|
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.2 μm.

An aqueous solution of 20 parts of tetrasodium ethylenediaminetetraacetate dissolved in 380 parts of deionized water was then further added to the dispersion containing the aggregate particles, followed by heating to 83° C.

Holding was carried out for 2 hours at 83° C. to obtain toner particles having a volume-average particle diameter of approximately 6.1 μm and an average circularity of 0.964.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 6 having a volume-average particle diameter of 5.9 μm. The formulation and properties of toner particle 6 are given in Tables 1 and 2.

Example 7

| Toner Particle 7 Production | |
|---|---|
| dispersion of amorphous resin fine particle 5 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 83° C.

Holding was carried out for 2 hours at 83° C. to obtain toner particles having a volume-average particle diameter of approximately 5.9 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 7 having a volume-average particle diameter of 5.7 μm. The formulation and properties of toner particle 7 are given in Tables 1 and 2.

Example 8

| Toner Particle 8 Production | |
|---|---|
| dispersion of amorphous resin fine particle 6 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 50° C. was then carried out on a heating water bath while adjusting the stirring rate as appropriate using a stirring blade such that the mixture was stirred. Holding at 50° C. was performed for 1 hour to obtain aggregate particles having a volume-average particle diameter of approximately 6.1 μm.

An aqueous solution of 20 parts of tetrasodium ethylenediaminetetraacetate dissolved in 380 parts of deionized water was then further added to the dispersion containing the aggregate particles, followed by heating to 80° C.

Holding was carried out for 2 hours at 80° C. to obtain toner particles having a volume-average particle diameter of approximately 5.9 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 8 having a volume-average particle diameter of 5.6 μm. The formulation and properties of toner particle 8 are given in Tables 1 and 2.

Example 9

| Toner Particle 9 Production | |
|---|---|
| dispersion of amorphous resin fine particle 7 | 347 parts |
| dispersion of crystalline resin fine particle 1 | 67 parts |
| dispersion of colorant fine particles | 50 parts |

-continued

| Toner Particle 9 Production | |
|---|---|
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 5.8 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 9 having a volume-average particle diameter of 5.5 μm. The formulation and properties of toner particle 9 are given in Tables 1 and 2.

Example 10

| Toner Particle 10 Production | |
|---|---|
| dispersion of amorphous resin fine particle 1 | 321 parts |
| dispersion of crystalline resin fine particle 1 | 92 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.1 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 6.0 μm and an average circularity of 0.967.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 10 having a volume-average particle diameter of 5.8 μm. The formulation and properties of toner particle 10 are given in Tables 1 and 2.

Example 11

| Toner Particle 11 Production | |
|---|---|
| dispersion of amorphous resin fine particle 1 | 273 parts |
| dispersion of crystalline resin fine particle 1 | 139 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.3 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 6.2 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 11 having a volume-average particle diameter of 5.9 μm. The formulation and properties of toner particle 11 are given in Tables 1 and 2.

Example 12

| Toner Particle 12 Production | |
|---|---|
| dispersion of amorphous resin fine particle 1 | 392 parts |
| dispersion of crystalline resin fine particle 1 | 23 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 50° C. was then carried out on a heating water bath while adjusting the stirring rate as appropriate using a stirring blade such that the mixture was stirred. Holding at 50° C. was performed for 1 hour to obtain aggregate particles having a volume-average particle diameter of approximately 6.1 μm.

An aqueous solution of 20 parts of tetrasodium ethylenediaminetetraacetate dissolved in 380 parts of deionized water was then further added to the dispersion containing the aggregate particles, followed by heating to 80° C.

Holding was carried out for 2 hours at 80° C. to obtain toner particles having a volume-average particle diameter of approximately 5.9 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 12 having a volume-average particle diameter of 5.6 μm. The formulation and properties of toner particle 12 are given in Tables 1 and 2.

Example 13

| Toner Particle 13 Production | |
|---|---|
| dispersion of amorphous resin fine particle 1 | 224 parts |
| dispersion of crystalline resin fine particle 1 | 185 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 50° C. was then carried out on a heating water bath while adjusting the stirring rate as appropriate using a stirring blade such that the mixture was stirred. Holding at 50° C. was performed for 1 hour to obtain aggregate particles having a volume-average particle diameter of approximately 6.2 μm.

An aqueous solution of 20 parts of tetrasodium ethylenediaminetetraacetate dissolved in 380 parts of deionized water was then further added to the dispersion containing the aggregate particles, followed by heating to 80° C.

Holding was carried out for 2 hours at 80° C. to obtain toner particles having a volume-average particle diameter of approximately 6.0 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 13 having a volume-average particle diameter of 5.8 μm. The formulation and properties of toner particle 13 are given in Tables 1 and 2.

Example 14

| Toner Particle 14 Production | |
|---|---|
| dispersion of amorphous resin fine particle 1 | 402 parts |
| dispersion of crystalline resin fine particle 1 | 14 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 50° C. was then carried out on a heating water bath while adjusting the stirring rate as appropriate using a stirring blade such that the mixture was stirred. Holding at 50° C. was performed for 1 hour to obtain aggregate particles having a volume-average particle diameter of approximately 6.2 μm.

An aqueous solution of 20 parts of tetrasodium ethylenediaminetetraacetate dissolved in 380 parts of deionized water was then further added to the dispersion containing the aggregate particles, followed by heating to 80° C.

Holding was carried out for 2 hours at 80° C. to obtain toner particles having a volume-average particle diameter of approximately 6.1 μm and an average circularity of 0.967.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 14 having a volume-average particle diameter of 5.9 μm. The formulation and properties of toner particle 14 are given in Tables 1 and 2.

Example 15

| Toner Particle 15 Production | |
|---|---|
| dispersion of amorphous resin fine particle 8 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 5.8 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 5.6 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 15 having a volume-average particle diameter of 5.3 μm. The formulation and properties of toner particle 15 are given in Tables 1 and 2.

Example 16

| Toner Particle 16 Production | |
|---|---|
| dispersion of amorphous resin fine particle 9 | 347 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 52° C. was then carried out on a heating water bath while adjusting the stirring rate as appropriate using a stirring blade such that the mixture was stirred. Holding at 52° C. was performed for 1 hour to obtain aggregate particles having a volume-average particle diameter of approximately 5.9 μm.

An aqueous solution of 20 parts of tetrasodium ethylenediaminetetraacetate dissolved in 380 parts of deionized water was then further added to the dispersion containing the aggregate particles, followed by heating to 84° C.

Holding was carried out for 2 hours at 84° C. to obtain toner particles having a volume-average particle diameter of approximately 5.7 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 16 having a volume-average particle diameter of 5.4 μm. The formulation and properties of toner particle 16 are given in Tables 1 and 2.

Comparative Example 1

| Toner Particle 17 Production | |
|---|---|
| dispersion of amorphous resin fine particle 10 | 342 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 83° C. to obtain toner particles having a volume-average particle diameter of approximately 5.8 μm and an average circularity of 0.967.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 17 having a volume-average particle diameter of 5.5 μm. The formulation and properties of toner particle 17 are given in Tables 1 and 2.

Comparative Example 2

| Toner Particle 18 Production | |
|---|---|
| dispersion of amorphous resin fine particle 1 | 342 parts |
| dispersion of crystalline resin fine particle 4 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.1 μm.

An aqueous solution of 20 parts of tetrasodium ethylenediaminetetraacetate dissolved in 380 parts of deionized water was then further added to the dispersion containing the aggregate particles, followed by heating to 93° C.

Holding was carried out for 2 hours at 93° C. to obtain toner particles having a volume-average particle diameter of approximately 5.9 μm and an average circularity of 0.965.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 18 having a volume-average particle diameter of 5.6 μm. The formulation and properties of toner particle 18 are given in Tables 1 and 2.

Comparative Example 3

| Toner Particle 19 Production | |
|---|---|
| dispersion of amorphous resin fine particle 11 | 342 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 54° C. was then carried out on a heating water bath while adjusting the stirring rate as appropriate using a stirring blade such that the mixture was stirred. Holding at 54° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 85° C.

Holding was carried out for 2 hours at 85° C. to obtain toner particles having a volume-average particle diameter of approximately 5.8 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 19 having a volume-average particle diameter of 5.5 μm. The formulation and properties of toner particle 19 are given in Tables 1 and 2.

Comparative Example 4

| Toner Particle 20 Production | |
|---|---|
| dispersion of amorphous resin fine particle 12 | 342 parts |
| dispersion of crystalline resin fine particle 1 | 67 parts |

-continued

| Toner Particle 20 Production | |
|---|---|
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 50° C. was then carried out on a heating water bath while adjusting the stirring rate as appropriate using a stirring blade such that the mixture was stirred. Holding at 50° C. was performed for 1 hour to obtain aggregate particles having a volume-average particle diameter of approximately 5.9 μm.

An aqueous solution of 20 parts of tetrasodium ethylenediaminetetraacetate dissolved in 380 parts of deionized water was then further added to the dispersion containing the aggregate particles, followed by heating to 82° C.

Holding was carried out for 2 hours at 82° C. to obtain toner particles having a volume-average particle diameter of approximately 5.7 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 20 having a volume-average particle diameter of 5.4 μm. The formulation and properties of toner particle 20 are given in Tables 1 and 2.

Comparative Example 5

| Toner Particle 21 Production | |
|---|---|
| dispersion of amorphous resin fine particle 13 | 342 parts |
| dispersion of crystalline resin fine particle 1 | 67 parts |
| dispersion of colorant fine particles | 50 parts |
| dispersion of release agent fine particles | 50 parts |
| deionized water | 400 parts |

These materials were introduced into a round stainless steel flask and were mixed; to this was then added an aqueous solution of 2 parts of magnesium sulfate dissolved in 98 parts of deionized water; and dispersion was performed for 10 minutes at 5,000 rpm using a homogenizer (Ultra-Turrax T50, IKA).

Heating to 57° C. was then carried out on a heating water bath while adjusting the stirring rate as appropriate using a stirring blade such that the mixture was stirred. Holding at 57° C. was performed for 1 hour to obtain aggregate particles having a volume-average particle diameter of approximately 6.0 μm.

An aqueous solution of 20 parts of tetrasodium ethylenediaminetetraacetate dissolved in 380 parts of deionized water was then further added to the dispersion containing the aggregate particles, followed by heating to 96° C.

Holding was carried out for 2 hours at 96° C. to obtain toner particles having a volume-average particle diameter of approximately 5.8 μm and an average circularity of 0.966.

Water was then introduced into the water bath and the aqueous toner particle dispersion was cooled to 25° C., after which, as a heating-induced annealing treatment, reheating to 50° C. and holding for 12 hours was carried out.

The aqueous toner particle dispersion was then cooled to 25° C. and subjected to solid-liquid separation by filtration followed by thorough washing of the residue with deionized water and drying using a vacuum dryer to obtain a toner particle 21 having a volume-average particle diameter of 5.5 μm. The formulation and properties of toner particle 21 are given in Tables 1 and 2.

Evaluation of Toner Properties

The following evaluations were performed using the toner particles 1 to 21 described above. The results are given in Table 2.

The toners 1 to 21 used in the evaluations were prepared by external additive addition by dry mixing, using a Henschel mixer (Mitsui Mining Co., Ltd.), 100 parts of the toner particle with 1.8 parts of silica fine particles that had been subjected to a hydrophobic treatment with silicone oil and had a specific surface area measured by the BET method of 200 $m^2/g$.

Evaluation of Storability

The toner was held at quiescence for 3 days in a controlled-temperature, controlled-humidity chamber and was then sieved for 300 seconds at a shaking amplitude of 1 mm using a sieve with an aperture of 75 μm, and the amount of toner remaining on the sieve was then evaluated according to the following criteria.

Evaluation Criteria

A: When subjected to sieving after standing at quiescence for 3 days in a controlled-temperature, controlled-humidity chamber at a temperature of 55° C. and a humidity of 10% RH, the amount of toner remaining on the sieve was less than 10%.

B: When subjected to sieving after standing at quiescence for 3 days in a controlled-temperature, controlled-humidity chamber at a temperature of 55° C. and a humidity of 10% RH, the amount of toner remaining on the sieve was 10% or more, but when subjected to sieving after standing at quiescence for 3 days in a controlled-temperature, controlled-humidity chamber at a temperature of 50° C. and a humidity of 10% RH, the amount of toner remaining on the sieve was less than 10%.

C: When subjected to sieving after standing at quiescence for 3 days in a controlled-temperature, controlled-humidity chamber at a temperature of 50° C. and a humidity of 10% RH, the amount of toner remaining on the sieve was 10% or more.

Evaluation of Low-Temperature Fixability

A two-component developer was prepared by mixing the toner at a toner concentration of 8 mass % with a ferrite carrier (average particle diameter=42 μm) that had been surface-coated with silicone resin. This two-component developer was filled into a commercial full-color digital copier (CLC1100, Canon Inc.), and an unfixed toner image (0.6 $mg/cm^2$) was formed on the image-receiving paper (64 $g/m^2$).

The fixing unit was removed from a commercial full-color digital copier (imageRUNNER ADVANCE C5051, Canon Inc.) and was modified to enable adjustment of the fixation temperature, and this was used to perform a fixing test on the unfixed toner image. A visual evaluation was carried out of the state provided by fixing the unfixed toner image at normal temperature and normal humidity and with the process speed set to 246 mm/second.

Evaluation Criteria

A: Fixation could be performed in the temperature range of equal to or less than 120° C.

B: Fixation could be performed in the temperature range greater than 120° C. and not more than 125° C.

C: Fixation could be performed in the temperature range greater than 125° C. and not more than 130° C.

D: Fixation could be performed in the temperature range greater than 130° C. and not more than 140° C.

E: The fixable temperature range was only in the temperature range greater than 140° C.

Evaluation of Charging Performance

Using the two-component developer used in the evaluation of the low-temperature fixability, the triboelectric charge quantity on the toner was measured and the charging performance of the toner was then evaluated using the criteria indicated below.

The triboelectric charge quantity for the toner was measured using an Espart Analyzer from Hosokawa Micron Corporation. The Espart Analyzer is an instrument that measures the particle diameter and charge quantity by introducing the sample particles into a detection section (measurement section) where both an electrical field and an acoustic field are simultaneously formed and measuring the velocity of particle motion by the laser doppler technique. The sample particle that has entered the measurement section of the instrument is subjected to the effects of the acoustic field and electrical field and falls while undergoing deflection in the horizontal direction, and the beat frequency of the velocity in this horizontal direction is counted. The count value is input by interrupt to a computer, and the particle diameter distribution or the charge distribution per unit particle diameter is displayed on the computer screen in real time. Once the amount of charge on a prescribed number has been measured, the screen is stopped and subsequent to this, for example, the three-dimensional distribution of charge quantity and particle diameter, the charge distribution by particle diameter, the average charge quantity (coulomb/weight), and so forth, is displayed on the screen. The triboelectric charge quantity for the toner can be measured by introducing the aforementioned two-component developer as the sample particle into the measurement section of the Espart Analyzer.

After the initial triboelectric charge quantity on the toner had been measured by this procedure, the two-component developer was held at quiescence for 1 week in a controlled-temperature, controlled-humidity chamber (temperature=30° C., humidity=80% RH) and the triboelectric charge quantity was then re-measured.

The triboelectric charge quantity retention rate was calculated by substituting the measurement results into the following formula and was evaluated using the criteria given below.

triboelectric charge quantity retention rate (%) for the toner=(triboelectric charge quantity for the toner after 1 week)/(initial triboelectric charge quantity for the toner)×100 formula Evaluation Criteria A: The triboelectric charge quantity retention rate for the toner is at least 80%.

B: The triboelectric charge quantity retention rate for the toner is at least 60% and less than 80%.

C: The triboelectric charge quantity retention rate for the toner is less than 60%.

TABLE 1

| | | hybrid resin | | | | | | | | | |
|---|---|---|---|---|---|---|---|---|---|---|---|
| | | | ether segment | | | | crystalline resin | | other amorphous resin | | SP value |
| Example No. | toner No. | No. | structure | molecular weight | content [mass %] | Tg [° C.] | No. | content [mass %] | No. | content [mass %] | \|SPh − SPc\| − \|SPp − SPc\| |
| 1 | 1 | A-1 | polypropylene glycol | 400 | 16 | 21 | B-1 | 14 | C-1 + C-2 | 58 | 0.8 |
| 2 | 2 | A-2 | polypropylene glycol | 400 | 16 | 8 | B-1 | 14 | C-1 + C-2 | 58 | 0.3 |
| 3 | 3 | A-1 | polypropylene glycol | 400 | 16 | 21 | B-2 | 14 | C-1 + C-2 | 58 | 0.0 |
| 4 | 4 | A-1 | polypropylene glycol | 400 | 16 | 21 | B-3 | 14 | C-1 + C-2 | 58 | −0.6 |
| 5 | 5 | A-1 | polypropylene glycol | 400 | 30 | 21 | B-1 | 14 | C-1 + C-2 | 42 | 0.8 |
| 6 | 6 | A-1 | polypropylene glycol | 400 | 50 | 21 | B-1 | 14 | C-1 + C-2 | 22 | 0.8 |
| 7 | 7 | A-1 | polypropylene glycol | 400 | 10 | 21 | B-1 | 14 | C-1 + C-2 | 62 | 0.8 |
| 8 | 8 | A-1 | polypropylene glycol | 400 | 55 | 21 | B-1 | 14 | C-1 + C-2 | 17 | 0.8 |
| 9 | 9 | A-1 | polypropylene glycol | 400 | 5 | 21 | B-1 | 14 | C-1 + C-2 | 67 | 0.8 |
| 10 | 10 | A-1 | polypropylene glycol | 400 | 15 | 21 | B-1 | 20 | C-1 + C-2 | 52 | 0.8 |
| 11 | 11 | A-1 | polypropylene glycol | 400 | 13 | 21 | B-1 | 30 | C-1 + C-2 | 44 | 0.8 |
| 12 | 12 | A-1 | polypropylene glycol | 400 | 18 | 21 | B-1 | 5 | C-1 + C-2 | 64 | 0.8 |
| 13 | 13 | A-1 | polypropylene glycol | 400 | 10 | 21 | B-1 | 40 | C-1 + C-2 | 36 | 0.8 |
| 14 | 14 | A-1 | polypropylene glycol | 400 | 19 | 21 | B-1 | 3 | C-1 + C-2 | 65 | 0.8 |
| 15 | 15 | A-3 | polypropylene glycol | 400 | 16 | 10 | B-1 | 14 | C-1 + C-2 | 58 | 0.8 |
| 16 | 16 | A-4 | polypropylene glycol | 3200 | 16 | 19 | B-1 | 14 | C-1 + C-2 | 58 | 0.8 |
| Comparative 1 | 17 | A-5 | polyethylene glycol | 400 | 16 | 19 | B-1 | 14 | C-1 + C-2 | 58 | 1.3 |
| Comparative 2 | 18 | A-1 | polypropylene glycol | 400 | 16 | 21 | B-4 | 14 | C-1 + C-2 | 58 | 2.0 |
| Comparative 3 | 19 | A-6 | polypropylene glycol | 290 | 16 | 19 | B-1 | 14 | C-1 + C-2 | 58 | 0.8 |
| Comparative 4 | 20 | | none | | | | B-1 | 14 | C-3 | 72 | none |
| Comparative 5 | 21 | | none | | | | B-1 | 14 | C-1 | 72 | none |

TABLE 2

| Example No. | toner No. | storability | low-temperature fixability | charging performance |
|---|---|---|---|---|
| 1 | 1 | A | A | A |
| 2 | 2 | B | A | B |
| 3 | 3 | A | A | A |
| 4 | 4 | A | A | A |
| 5 | 5 | A | A | A |
| 6 | 6 | B | A | A |
| 7 | 7 | A | B | A |
| 8 | 8 | B | A | B |
| 9 | 9 | A | C | A |
| 10 | 10 | A | A | A |
| 11 | 11 | B | A | B |
| 12 | 12 | A | B | A |
| 13 | 13 | B | A | B |
| 14 | 14 | A | C | A |
| 15 | 15 | B | A | B |
| 16 | 16 | B | A | B |
| Comparative 1 | 17 | A | D | A |
| Comparative 2 | 18 | A | E | A |
| Comparative 3 | 19 | A | D | A |
| Comparative 4 | 20 | C | A | C |
| Comparative 5 | 21 | A | E | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-7435, filed Jan. 19, 2017, which is hereby incorporated by reference herein in its entirety.

What is claimed is:

1. A toner comprising:

a toner particle that contains a hybrid resin A and a crystalline polyester resin B;

the hybrid resin A having a polyester segment, and a polypropylene glycol segment that has a number-average molecular weight of at least 300; and the polyester segment having a structure derived from a condensation reaction between a dicarboxylic acid having an aromatic ring and a diol having an aromatic ring, wherein $|SPh-SPc|-|SPp-SPc|<1$ where SPh is the SP value of the polyester segment of hybrid resin A, SPc is the SP value of crystalline polyester resin B, and SPp is the SP value of the polypropylene glycol segment of hybrid resin A.

2. The toner according to claim 1, wherein the content of hybrid resin A in the toner particle is 10 to 50 mass %.

3. The toner according to claim 1, wherein the content of crystalline polyester resin B in the toner particle is 5 to 30 mass %.

4. The toner according to claim 1, wherein the glass transition temperature of hybrid resin A is 20 to 40° C.

5. The toner according to claim 1, wherein the content of a monomer unit derived from the polypropylene glycol in the total monomer unit forming hybrid resin A is 2.5 to 20 mol %.

6. The toner according to claim 1, wherein the number-average molecular weight of the polypropylene glycol segment is 300 to 3,000.

7. The toner according to claim 1, wherein the diol contains a propylene oxide adduct of bisphenol A.

8. The toner according to claim 1, wherein the dicarboxylic acid contains a terephthalic acid.

9. The toner according to claim 1, wherein crystalline polyester resin B has a structure derived from a condensation reaction between a diol represented by formula (I) and a dicarboxylic acid represented by formula (II):

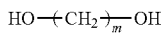

(I)

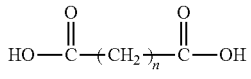

(II)

where n and m represent integers from 4 to 10.

* * * * *